US008159808B2

(12) United States Patent
Torres

(10) Patent No.: US 8,159,808 B2
(45) Date of Patent: Apr. 17, 2012

(54) +28V AIRCRAFT TRANSIENT SUPPRESSION

(75) Inventor: Roland Torres, Los Alamitos, CA (US)

(73) Assignee: Raytheon Company, Waltham, MA (US)

( * ) Notice: Subject to any disclaimer, the term of this patent is extended or adjusted under 35 U.S.C. 154(b) by 358 days.

(21) Appl. No.: 12/393,746

(22) Filed: Feb. 26, 2009

(65) Prior Publication Data

US 2010/0214711 A1 Aug. 26, 2010

(51) Int. Cl.
*H01H 47/22* (2006.01)

(52) U.S. Cl. ..... 361/160

(58) Field of Classification Search ..... 361/160; 631/160

See application file for complete search history.

(56) References Cited

U.S. PATENT DOCUMENTS 5,561,578 A * 10/1996 Shimoyanagida ..... 361/91.2
2001/0043450 A1 11/2001 Seale et al.

FOREIGN PATENT DOCUMENTS

| | | | |
|---|---|---|---|
| DE | 4134056 | A1 | 4/1992 |
| DE | 299 09 901 | U1 | 9/1999 |
| DE | 10155969 | A1 | 5/2003 |
| DE | 10 2007 031995 | A1 | 1/2009 |
| EP | 1 300 862 | A1 | 4/2003 |

OTHER PUBLICATIONS

Intl. Preliminary Report on Patentability dated May 31, 2011 of PCT/US09/62064 filed Oct. 26, 2009 (10 pages).

* cited by examiner

*Primary Examiner* — Jared Fureman
*Assistant Examiner* — Nicholas Ieva
(74) *Attorney, Agent, or Firm* — Cantor Colburn LLP

(57) ABSTRACT

An apparatus and method for suppressing voltage fluctuations across a relay coil is disclosed. The method includes the steps of monitoring a voltage drop across a relay coil by a difference amplifier; providing an output of a reference source and an output of the difference amplifier to an integrator amplifier; providing an output of the integrator amplifier to a transistor; and driving the relay coil by controlling an output of the transistor based on the output of the integrator amplifier, wherein the output of the reference source is selectively applied to the integrator amplifier in response to a monitored undesired voltage fluctuations across the relay coil.

18 Claims, 3 Drawing Sheets

Figure 1 – Conventional Art

+28V AIRCRAFT TRANSIENT SUPPRESSION

GOVERNMENT RIGHTS

This invention was made with U.S. Government support under a withheld contract. The Government has certain rights in this invention.

BACKGROUND

This disclosure relates generally to the field of electronics and, more specifically, to systems and methods for suppressing transient voltages across a relay coil.

Power conditioning units (PCU's) use airborne aircraft +28 Vdc bus to power relay coils. These coils are normally rated for +29 Vdc maximum, with a few rated for +32 Vdc maximum. The +28 Vdc power specification is 22 to 29 Vdc, with an additional 1.5 V of ripple. In addition, a 50 V transient voltage may also be present.

To solve transients and over voltage conditions on the +28 Vdc bus, past attempts have included connecting a zener diode or a transient suppressor across the bus, or by simply doing nothing. Zener diodes and transient suppressors suffer from the limitation that they will most likely burn up after only one over voltage condition. What is needed is an apparatus and method that handles such transient voltage conditions without destroying components in a PCU.

SUMMARY

In accordance with various embodiments, a method of suppressing voltage fluctuations across a relay coil is disclosed. The method comprises monitoring a voltage drop across a relay coil by a difference amplifier; providing an output of a reference source and an output of the difference amplifier to an integrator amplifier; providing an output of the integrator amplifier to a transistor; and driving the relay coil by controlling an output of the transistor based on the output of the integrator amplifier, wherein the output of the reference source is selectively applied to the integrator amplifier in response to a monitored undesired voltage fluctuations across the relay coil.

In accordance with various embodiments of this disclosure, an apparatus that suppresses voltage fluctuations across a relay coil is disclosed. The apparatus comprises a difference amplifier configured to monitor a voltage drop across the relay coil; an integrator amplifier configured to provide an output responsive to an input from a reference source and the output of the difference amplifier; a transistor arranged in series with the relay coil and configured to be controlled by the output of the integrator; and a controller configured to control the reference source so as to drive the relay coil by controlling an output of the transistor so as to suppress voltage fluctuations across the relay coil.

In accordance with various embodiments of this disclosure, an apparatus for suppressing voltage fluctuations in a power conditioner unit that powers a power relay coil is disclosed. The apparatus comprises an active feedback loop configured to monitor a voltage drop across the power relay coil to apply power to the power relay coil so as to suppress voltage fluctuations associated therewith.

These and other features and characteristics, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various Figures. It is to be expressly understood, however, that the drawings are for the purpose of illustration and description only and are not intended as a definition of the limits of claims. As used in the specification and in the claims, the singular form of "a", "an", and "the" include plural referents unless the context clearly dictates otherwise.

DETAILED DESCRIPTION

Figure 1:
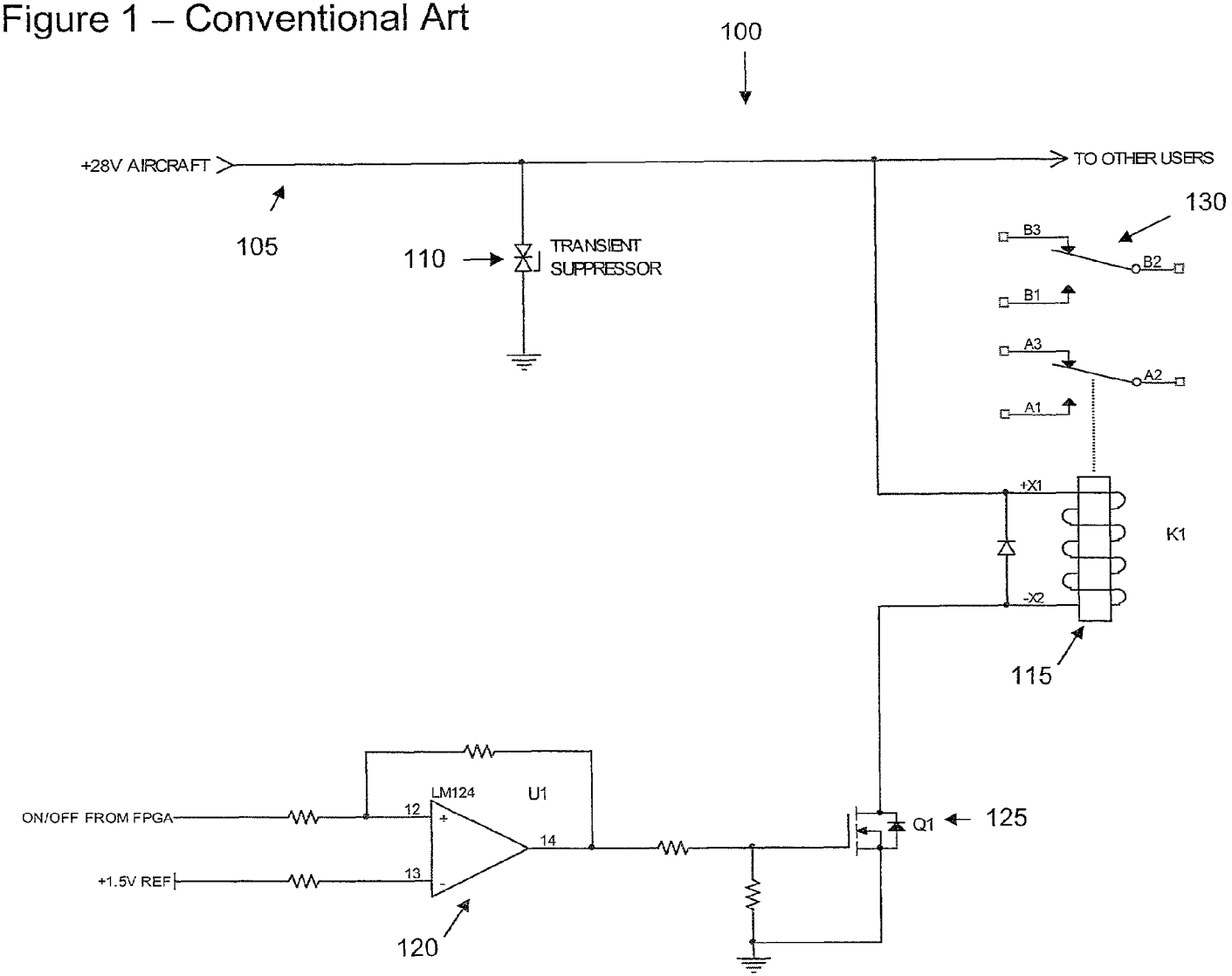
FIG. 1 shows a conventional design to drive a relay coil.

In the description that follows, like components have been given the same reference numerals, regardless of whether they are shown in different embodiments. To illustrate embodiments of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

This disclosure monitors the voltage across a relay coil and provides feedback to an on/off circuit or an integrator. The integrator may be configured to maintain a predetermined voltage across the relay coil by driving a transistor, e.g., a field effect transistor (FET). The relay coil voltage rating is thereby not exceeded, regardless of the transient performance of the +28 Vdc bus.

In an embodiment, the +28 Vdc aircraft bus characteristics may be defined by MIL-STD-704, which states that the aircraft steady state voltage will be between 22 to 29 Vdc, with a ripple voltage of 1.5 V. This ripple voltage is not included in steady state limits. Therefore, in this embodiment, the aircraft voltage can be as high as 30.5 V. In addition to the steady state values, transients to 50 V for 12.5 ms can occur and then decay to 32 V for 75 ms.

Three power relays are generally used in PCU's. They are the power relay to switch 400 Hz prime power, in-rush relay to switch in current limiting resistors and discharge relay (high voltage type) to switch in resistors to discharge large output capacitors.

These relays have the following contact and coil characteristics as detailed in Table 1.

TABLE 1

Typical relay contact and coil characteristics

| | | | COIL VOLTAGE | |
|---|---|---|---|---|
| RELAY | VENDOR | CONTACT LIFE | TYPICAL | MAXIMUM |
| Power | Leach | 100k cycles min.* | +28 Vdc | +29 Vdc |
| In-rush | Leach | 200k cycles min.* | +28 Vdc | +29 Vdc |
| Discharge | Cii Tech | 100k cycles | +26.5 Vdc | +32 Vdc |

*Contact life at 25% rated load

Previous designs have used zener diodes or transient suppressors across the +28 Vdc aircraft bus in an attempt to limit the transient voltage. A typical circuit configuration 100 is shown in FIG. 1. As shown in the Figure, transient suppressor 110, such as a zener diode, is used to across +28 Vdc aircraft bus 105 in an attempt to limit transient voltages. Relay coil 115 are controlled by driver 120 and field-effect transistor 125 arranged in series. When activated, relay coil 115 controls switch 130. Both an +1.5 V reference signal and an on/off signal are provided from field programmable gate array (not shown) and are transmitted to driver 120. An output of driver 120 is supplied to field-effect transistor 125, which is then used to control relay coil 115.

For example, the F-18 aircraft uses a RUG PCU having 500 watt peak pulse transient suppressor (part number 1N6120A) and the B-2 aircraft uses a RMP PCU having 1500 watt peak pulse transient suppressor (part number 1N6156A), which is from the same family as the F-18 RUG part. The only difference is the peak power capability. Subsequent analysis showed that the B-2 RMP part was insufficient in handling more than one voltage transient. As a result of this analysis, the part was removed from the circuit to prevent it from failing and causing (possible) board damage.

Figure 2:
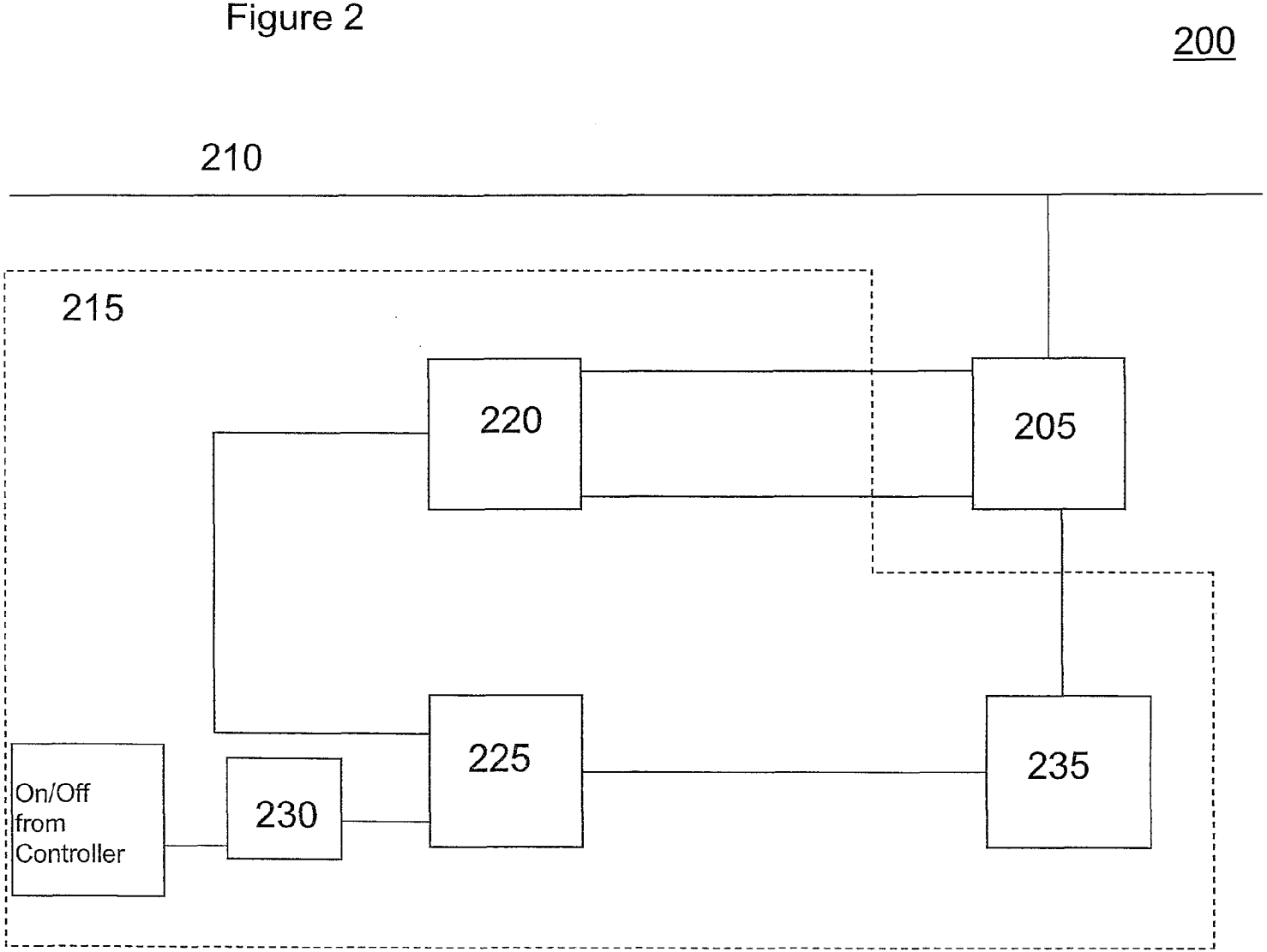
FIG. 2 shows a block diagram of a design to drive relay coil in accordance with an embodiment.
Figure 3:
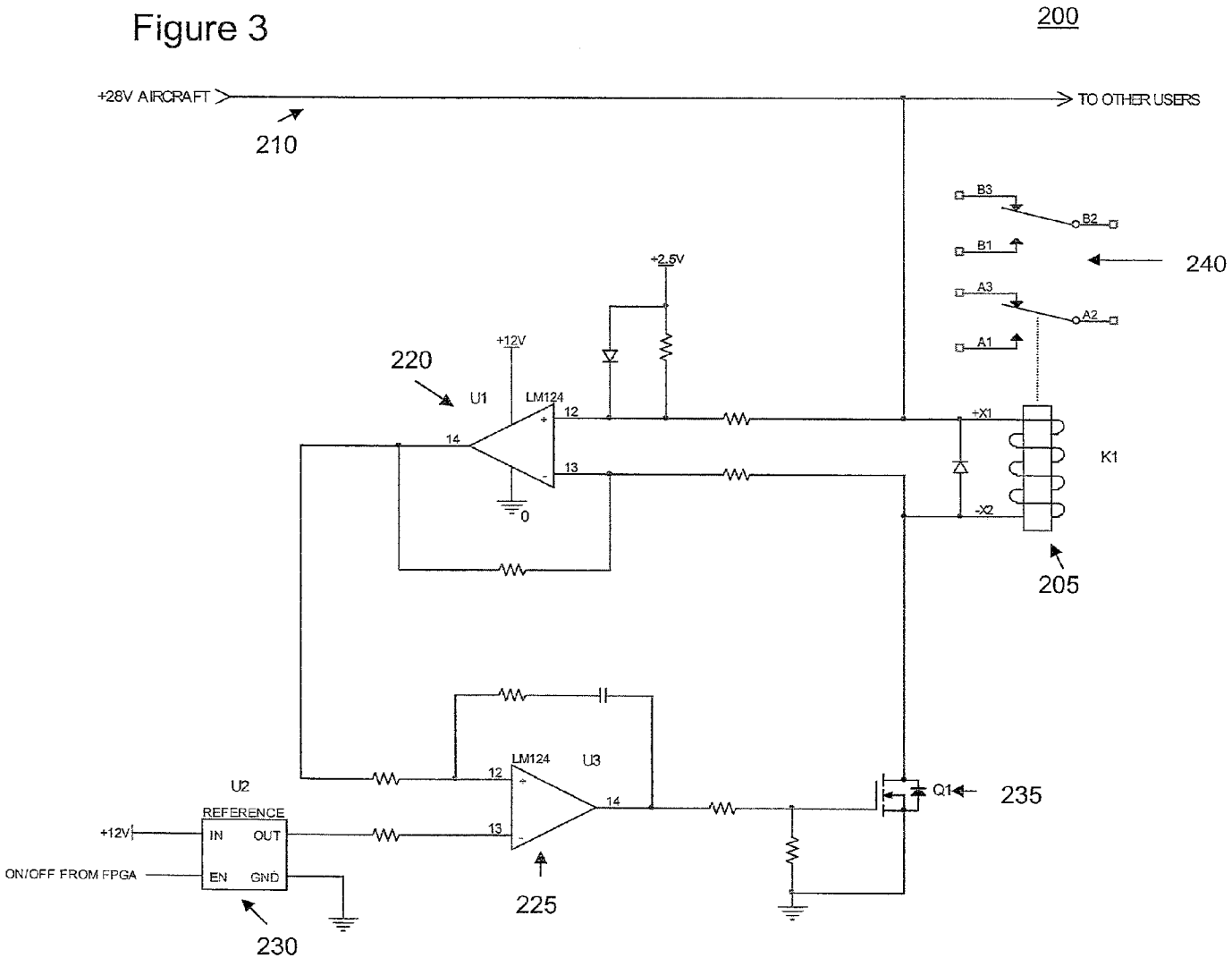
FIG. 3 shows an exemplary circuit diagram configured to drive a relay coil in accordance with one or more embodiments.

FIG. 2 shows a simplified design to drive relay coil in accordance with an aspect of the present disclosure. FIG. 3 shows an exemplary circuit diagram in accordance with FIG. 2. The design, indicated generally by 200, includes relay coil 205 that is powered by bus 210. In some embodiments, bus 210 may have a voltage of +28 V, which is suitable for aircraft usage. Other bus voltages may be used that are in accordance with bus characteristics defined by MIL-STD-704, including a steady state voltage of about 22 to 29 Vdc, with a ripple voltage of 1.5 V. Active feedback loop 215 is configured to monitor the voltage across relay coil 205 and to suppress transient voltage or voltage spikes by turning power off to relay coil 205. Thus, preventing damage from occurring to relay coil 205. When activated, relay coil 205 controls switch 240.

Active feedback loop 215 may include difference amplifier 220, integrator amplifier 225, reference source 230, and transistor 235. Voltage across relay coil 205 is measured by difference amplifier 220. In some embodiments, output from difference amplifier 220 is scaled down to +5 V or +3.3 V, depending upon the type of reference source used. The measured voltage difference from difference amplifier 220 is provided as an input to integrator amplifier 225. By way of a non-limiting example, difference amplifier 220 and integrator amplifier 225 may both be an integrated circuit (IC), such as, for example model number LM124, which is a low power quad operational amplifier manufactured by National Semiconductor. A reference signal is provided from reference source 230 to another input of integrator amplifier 225. Reference source 230 is provided with an on/off signal 240 from controller (not shown). In some embodiments, controller may be a field programmable gate array. Integrator amplifier 225 provides an output voltage based on the two inputs and supplies the output voltage to transistor 235. By way of a non-limiting example, when an overvoltage occurs on bus 210, excess voltage, as measured by difference amplifier 220 and integrator amplifier 225, is dissipated across transistor 235. In some embodiments, transistor 235 may be a field-effect transistor. Controller (not shown) is configured to control enable pin of reference source 230, which allows integrator amplifier 225 to turn on or off power to relay coil 205.

Regulation is achieved by setting the output of difference amplifier 220. By way of a non-limiting example, if +28 V is the desired voltage across relay coil 205, the difference amplifier gain is set to yield an output of +5 V. In this case, reference source 230 output is +5 V. Integrator amplifier 225 is configured to drive transistor 235 to yield +28 V across relay coil 205. If bus 210 is at 30 V, transistor 235 will drop 2 V, with the remaining 28 V dropped across relay coil 205. If bus 210 has a transient of 50 V, transistor 235 will drop 22 V.

By way of another non-limiting example, in the case of a lower voltage on bus 210, such as 22 V, transistor 235 will drop a very small amount of voltage (approximately 0.1 V), with the vast majority of the 22 V dropped across relay coil 205.

In the event that relay coil 205 must be turned off, the controller (not shown), such as a field programmable gate array, will turn off reference source 230 via enable pin (not shown). The output of reference source 230 will then drop to zero volts and the output of integrator amplifier 225 will be very close to zero volts. This will turn off transistor 235 and all of the bus voltage will be dropped across transistor 235.

This design will be able to turn relay coil 205 on and off and that no more than 28 V will appear across relay coil 205. Relay coil 205 will be able to operate with the correct coil voltage, as per the manufacturer's specifications.

Although the above disclosure discusses what is currently considered to be a variety of useful embodiments, it is to be understood that such detail is solely for that purpose, and that the appended claims are not limited to the disclosed embodiments, but, on the contrary, is intended to cover modifications and equivalent arrangements that are within the spirit and scope of the appended claims.

What is claimed is:

1. A method of suppressing voltage fluctuations across a relay coil, the method comprising:

monitoring a voltage drop across a relay coil by a difference amplifier;

providing an output of a reference source and an output of the difference amplifier to an integrator amplifier;

providing an output of the integrator amplifier to a transistor; and driving the relay coil by controlling an output of the transistor based on the output of the integrator amplifier, wherein the output of the reference source is selectively applied to the integrator amplifier in response to a monitored undesired voltage fluctuations across the relay coil.

2. The method according to claim 1, comprising reducing an output of the difference amplifier, wherein the output is either +5 V or +3.3 V.

3. The method according to claim 2, comprising determining the reduced output based on a type of the reference source.

4. The method according to claim 3, comprising setting a gain of the difference amplifier to yield an output of +5 V when +28 V is the desired voltage across the coil.

5. The method according to claim 4, comprising driving the transistor to yield +28 V across the relay coil using the integrator amplifier.

6. The method according to claim 5, comprising turning off the relay coil by applying a desired signal from a controller to the transistor.

7. The method according to claim 6, wherein the transistor is configured to dissipate any remaining bus overvoltage due to the voltage fluctuations.

8. The method according to claim 1, wherein the controller comprises a field-programmable gate array.

9. The method according to claim 1, wherein the transistor comprises a field-effect transistor.

10. The method of claim 1, wherein the relay coil is coupled to a +28 V direct current (DC) bus for driving one or more switches.

11. An apparatus that suppresses voltage fluctuations the apparatus comprising:

a relay coil across which the voltage fluctuations are suppressed;

a difference amplifier configured to monitor a voltage drop across the relay coil;

an integrator amplifier configured to provide an output responsive to an input from a reference source and the output of the difference amplifier;

a transistor arranged in series with the relay coil and configured to be controlled by the output of the integrator amplifier; and a controller configured to control the reference source so as to drive the relay coil by controlling an output of the transistor so as to suppress voltage fluctuations across the relay coil.

12. The apparatus according to claim 11, wherein the controller comprises a field-programmable gate array.

13. The apparatus according to claim 11, wherein the transistor comprises a field-effect transistor.

14. The apparatus of claim 11 further comprising:

a direct current (DC) bus coupled to the relay coil and configured to power the relay coil; and one or more switches coupled to and driven by the relay coil.

15. An apparatus for suppressing voltage fluctuations in a power conditioner unit that powers a power relay coil, the apparatus comprising:

an active feedback loop configured to monitor a voltage drop across the power relay coil to apply power to the power relay coil so as to suppress voltage fluctuations associated therewith, wherein the active feedback loop comprises:

a difference amplifier configured to monitor a voltage drop across the power relay coil;

an integrator amplifier configured to receive an output of the difference amplifier;

a transistor coupled in series with the power relay coil and configured to receive an output of the integrator amplifier, wherein overvoltages due to the voltage fluctuations are dissipated across the transistor such that the voltage drop across the power relay coil is constant.

16. The apparatus according to claim 15, wherein the power to the power relay coil is turned on or off responsive to the monitored voltage drop.

17. The apparatus according to claim 15, wherein the integrator amplifier is configured to receive an output from a reference source in addition to the output of the difference amplifier and the active feedback loop further comprises:

a controller configured to drive the power relay coil by controlling an output of the transistor, wherein the controller controls the reference source that allows the transistor to turn the power relay coil on or off to suppress voltage fluctuations.

18. The apparatus of claim 15, wherein the power relay coil is coupled to a +28 V direct current (DC) bus for driving one or more switches.

* * * * *